United States Patent [19]

Hayashi

[11] Patent Number: 4,545,335

[45] Date of Patent: Oct. 8, 1985

[54] COOLING SYSTEM FOR AUTOMOTIVE ENGINE OR THE LIKE

[75] Inventor: Yoshimasa Hayashi, Kamakura, Japan

[73] Assignee: Nissan Motor Co., Ltd., Yokohama, Japan

[21] Appl. No.: 602,451

[22] Filed: Apr. 20, 1984

[30] Foreign Application Priority Data

May 19, 1983 [JP] Japan ..... 58-86632
Aug. 9, 1983 [JP] Japan ..... 58-145467
Aug. 9, 1983 [JP] Japan ..... 58-145470

[51] Int. Cl.[4] ..... F01P 11/02
[52] U.S. Cl. ..... 123/41.27
[58] Field of Search ..... 123/41.02, 41.08, 41.1, 123/41.2, 41.21, 41.24, 41.27, 41.51, 41.54

[56] References Cited

U.S. PATENT DOCUMENTS 3,425,400 2/1969 Scherenberg ..... 123/41.51
4,387,670 6/1983 Robin et al. ..... 123/41.08
4,425,766 1/1984 Claypole ..... 123/41.12

*Primary Examiner*—William A. Cuchlinski, Jr.
*Attorney, Agent, or Firm*—Schwartz, Jeffery, Schwaab, Mack, Blumenthal & Evans

[57] ABSTRACT

The present invention features an arrangement wherein in order to prevent atmospheric air (or the like) from entering the cooling system of an engine wherein the coolant is boiled and the vapor used as a vehicle for removing heat from the engine, upon the engine being stopped or the temperature of the system falling below a predetermined level, the cooling system is filled with liquid coolant under the influence of the sub-atmospheric pressure which tends to develop under such conditions. Additionally, the coolant can be pumped in, in the event that some air has entered or remains in either of the coolant jacket or radiator associated therewith, to displace said non-condensible matter out of the system and thus completely obviate any tendancy for which would otherwise tend to produce a heat exchange reducing "embolism" to occur in the radiator conduiting.

20 Claims, 19 Drawing Figures

COOLING SYSTEM FOR AUTOMOTIVE ENGINE OR THE LIKE

BACKGROUND OF THE INVENTION

1. Field of the Invention

The present invention relates generally to a cooling system for an internal combustion engine wherein a liquid coolant is boiled and the vapor used as a vehicle for removing heat from the engine and more specifically to such an engine wherein to avoid contamination of the system with non-condensibles such as air and the like, the coolant jacket and heat exchanger (radiator) are automatically filled with liquid coolant upon the temperature falling below a predetermined level.

2. Description of the Prior Art

In currently used "water cooled" internal combustion engines, the engine coolant (liquid) is forcefully circulated by a water pump through a circuit including the engine coolant jacket and a radiator (usually fan cooled). This type of system encounters the drawback that a large volume of water is required to be circulated between the radiator and the coolant jacket in order to remove the required amount of heat. Further, due to the large mass of water inherently required, the warm-up characteristics of the engine are undesirably sluggish. For example, if the temperature difference between the inlet and discharge ports of the coolant jacket is 4 degrees, the amount of heat which 1 Kg of water may effectively remove from the engine under such conditions is 4 Kcal. Accordingly, in the case of an engine having 1800 cc displacement (by way of example) is operated at full throttle, the cooling system is required to remove approximately 4000 Kcal/h. In order to acheive this a flow rate of 167 l/min (viz., $4000-60\times\frac{1}{4}$) must be produced by the water pump. This of course undesirably consumes horsepower.

With the above type of engine cooling system, the temperature of the coolant is prevented from boiling and is maintained within a predetermined narrow temperature range irrespective of the load and/or mode of operation of the engine, despite the fact that it is advantageous from the point of fuel economy to raise the temperature of the engine during low-medium load "urban" cruising to increase the thermal efficiency of the engine and reduce same during high speed and/or high load (full throttle) modes of operation for engine protection.

One arrangement which has attempted to overcome the above mentioned problems is disclosed in Japanese Patent Application First Provisional Publication No. Sho 58-5449. This arrangement senses the temperature of the combustion chamber walls and controls an electrically powered water pump in accordance therewith. However, as in the conventional arrangement disclosed hereinbefore, still a large volume of water or like coolant is required and during high load operation the electric pump is continuously engergized consuming similar large amounts of energy.

Another arrangement via which the temperature of the engine may be varied in response to load is disclosed in U.S. Pat. No. 2,420,436 issued in May 1947 in the name of Mallory. This document discloses an arrangement wherein the volume of water in the cooling system is increased and decreased in response to engine temperature and load. However, with this arrangement only the water level in the radiator is varied while the water jacket, formed in the cylinder block and cylinder head, remains full under the influence of a water circulation pump. Accordingly, this arrangement has suffered from the drawback that a power consuming water circulation pump is required. The temperature by which the coolant can be increased is limited by the fact that the water is prevented from boiling and in that the notable mass of water increases the weight and warm-up time of the engine.

FIG. 1 shows an arrangement disclosed in Japanese Patent Application Second Provisional Publication No. Sho 57-57608. This arrangement has attempted to vapourize a liquid coolant and use the gaseous form thereof as a vehicle for removing heat from the engine. In this system the radiator 1 and the coolant jacket 2 are in constant and free communication via conduits 3, 4 whereby the coolant which condenses in the radiator 1 is returned to the coolant jacket 2 little by little under the influence of gravity. This arrangement has suffered from the drawbacks that the radiator, depending on its position with respect to the engine proper tends to be at least partially filled with liquid coolant. This greatly reduces the surface area via which the gaseous coolant (for example steam) can effectively release its latent heat of vaporization and accordingly condense and thus has lacked any notable improvement in cooling efficiency. Further, with this system the pressure is maintained at atmospheric level in order to maintain the boiling point of the coolant constant and thus lacks any response to changes in engine load and speed. In order to maintain the pressure within the coolant jacket and radiator at atmospheric level, a gas permeable water shedding filter 5 is arranged as shown, to permit the entry of air into and out of the system. However, this filter permits gaseous coolant to gradually escape from the system, inducing the need for frequent topping up of the coolant level. A further problem with this arrangement has come in that some of the air, which is sucked into the cooling system as the engine cools, tends to dissolve in the water, whereby upon start up of the engine, the dissolved air tends to form small bubbles in the radiator which adhere to the walls thereof forming an insulating layer. The undissolved air tends to collect in the upper section of the radiator and inhibit the convention-like circulation of the vapor from the cylinder block to the radiator. This of course further deteriorates the performance of the device.

European Patent Application Provisional Publicaton No. 0 059 423 published on Sept. 8, 1982 discloses another arrangement wherein, liquid coolant in the coolant jacket of the engine 1, is not circulated therein and permitted to absorb heat to the point of boiling. The gaseous coolant thus generated is adiabatically compressed in a compressor 3 so as to raise the temperature and pressure thereof and introduced into a heat exchanger 4. After condensing, the coolant is temporarily stored in a reservoir 5 and recycled back into the coolant jacket via flow control valve 6.

This arrangement has suffered from the drawback that air tends to leak into the system upon cooling thereof. This air tends to be forced by the compressor along with the gaseous coolant into the radiator. Due to the difference in specific gravity, the air tends to rise in the hot environment while the coolant which has condensed moves downwardly. The air, due to this inherent tendency to rise, forms large bubbles of air which cause a kind of "embolism" in the radiator and badly impair the heat exchange ability thereof.

U.S. Pat. No. 4,367,699 issued on Jan. 11, 1983 in the name of Evans (see FIG. 2 of the drawings) discloses an engine system wherein the coolant is boiled and the vapor used to remove heat from the engine. This arrangement features a separation tank 6 wherein gaseous and liquid coolant are initially separated. The liquid coolant is fed back to the cylinder block 7 under the influence of gravity while the "dry" gaseous coolant (steam for example) is condensed in a fan cooled radiator 8. The temperature of the radiator is controlled by selective energizations of the fan 9 to maintain a suitable rate of condensation therein. Condensate from the radiator 8 is collected in a small reservoir-like arrangement 10 and pumped back up to the separation tank via a small pump 11.

This arrangement while providing an arrangement via which air can be initially purged from the system tends to, due to the nature of the arrangement which permits said initial non-condensible matter to be purged from the system, suffer from rapid loss of coolant when operated at relatively high altitudes. Further, once the engine cools, air is relatively freely admitted back into the system. Moreover the provision of the separation tank 6 renders engine layout difficult.

Japanese Patent Application First Provisional Publication No. Sho 56-32026 (see FIG. 3 of the drawings) discloses an arrangement wherein the structure defining the cylinder head and cylinder liners are covered in a porous layer of ceramic material 12 and coolant sprayed into the cylinder block from shower-like arrangements 13 located above the cylinder heads 14. The interior of the coolant jacket defined within the engine proper is essentially filled with gaseous coolant during engine operation during which liquid coolant sprayed onto the ceramic layers 12. However, this arrangement has proved totally unsatifactory in that upon boiling of the liquid coolant absorbed into the ceramic layers the vapor thus produced escaping into the coolant jacket inhibits the penetration of liquid coolant into the layers whereby rapid overheating and thermal damage of the ceramic layers 12 and/or engine soon results. Further, this arrangement is plagued with air contamination and blockages in the radiator similar to the compressor equipped arrangement discussed above.

Another air purge arrangement for a so called "vapor cooled" type engine of the nature disclosed hereinabove in connection with U.S. Pat. No. 4,367,699, is found in U.S. Pat. No. 3,292,946 issued in Aug. 11, 1942 in the name of Karig. This arrangement includes a heat sensitive bulb which is exposed to the interior of the condensor or radiator. The bulb contains a volatile liquid and controls the opening and closing of a diaphragm valve. With this arrangement, upon a sufficiently high temperature prevailing in the condensor, the diaphragm valve closes a vent port through which air and the like is discharged during intial warm-up. However, this arrangement aims at maintaining a uniform temperature regardless of variations in the conditions to which the engine is exposed and accordingly lacks any ability to vary the engine temperature in response to changes in engine speed and engine load and in no way seeks to induce conditions which minimize the tendency for contaminating air to lead back into the system when it cools down after operation.

SUMMARY OF THE INVENTION

It is an object of the present invention to provide an cooling system for an internal combustion engine wherein a liquid coolant is boiled and the vapor used as heat transfer medium and which minimizes the tendancy for air to leak into the system during non-use and/or when cooling after use.

It is a further object to provide a system which, in addition to minimizing the tendency for air or the like contaminating non-condensible matter to the inducted into the system, further enables the purging of such matter during either or both of cooling and warming-up of the system.

In brief, the above mentioned objects are fullfilled by an arrangement wherein, in order to prevent atmospheric air (or the like) from entering the cooling system of an engine of the above mentioned type, upon the engine being stopped or the temperature of the system falling below a predetermined level, the cooling system is filled with liquid coolant under the influence of the sub-atmospheric pressure which tends to develop under such conditions. Additionally, the coolant can be pumped in, in the event that some air has entered or remains in either of the coolant jacket or radiator associated therewith, to displace said non-condensible matter out of the system and thus completely obviate any tendency to produce a heat exchange reducing "embolism" in the radiator piping.

More specifically, the present invention takes the form of an internal combustion engine having a combustion chamber and which features a coolant jacket into which coolant is introduced in liquid form and maintained at a level above the combustion chamber, the liquid coolant being permited to boil, a radiator for condensing the gaseous coolant generated by the boiling of the liquid coolant in the coolant jacket, a reservoir communicated with one of the coolant jacket and the radiator, the reservoir being arranged to store coolant therein and a control arrangement for normally blocking communication between the reservoir and the one of the coolant jacket and the radiator and for establishing fluid communication therebetween when one of the pressure and temperature within the radiator and coolant jacket tends to fall below a predetermined level.

BRIEF DESCRIPTION OF THE DRAWINGS

The features and advantages of the arrangement of the present invention will become more clearly appreciated from the following description taken in conjunction with the accompanying drawings in which.

DESCRIPTION OF THE PREFERRED EMBODIMENTS

Figure 4:
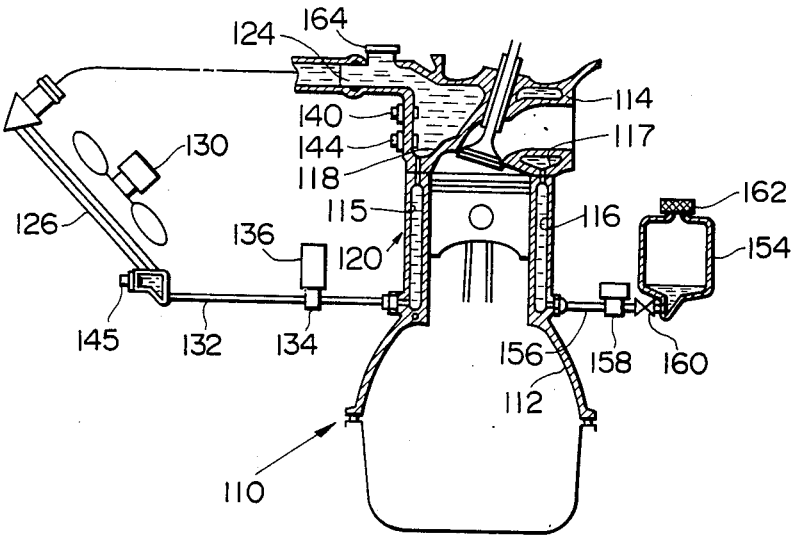
FIGS. 4 and 5 show a first embodiment of the present invention.
Figure 5:
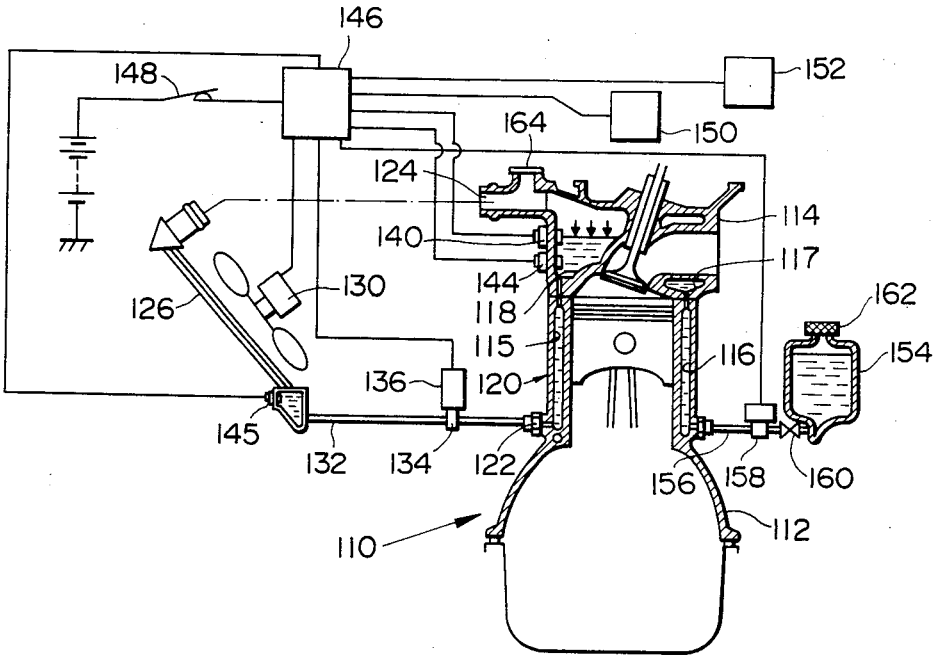

FIGS. 4 and 5 show an engine system which incorporates a first embodiment of the present invention. In this arrangement an internal combustion engine 110 includes a cylinder block 112 on which a cylinder head 114 is detachably secured. The cylinder head and cylinder block include suitable cavities 115–118 which define a coolant jacket 120. The coolant is introduced into the coolant jacket 120 through a port 122 formed in the cylinder block 112. In this embodiment port 122 is arranged to communicate with a lower level of the coolant jacket 120.

Fluidly communicating with a vapor discharge port 124 of the cylinder head 114, is a radiator or heat exchanger 126.

Located suitably adjacent the radiator 126 is an electrically driven fan 130. Disposed in a coolant return conduit 132 is a return pump 134. In this embodiment, the pump is driven by an electric motor 136.

In order to control the level of coolant in the coolant jacket, a level sensor 140 is disposed as shown. It will be noted that this sensor is located at a level higher than that of the combustion chambers, exhaust ports and valves (viz., structure subject to high heat flux) so as to maintain same securely immersed in coolant and therefore attenuate engine knocking and the like due to the formation of localized zones of abnormally high temperature or "hot spots".

Located below the level sensor 140 so as to be immersed in the liquid coolant is a temperature sensor 144. Disposed in close proximity of the bottom of the radiator 126 is a second level sensor 145. This level sensor is arranged to output a signal upon the level of coolant in the radiator falling therebelow.

The output of the level sensors 140 & 145 and the temperature sensor 144 are fed to a control circuit 146 or modulator which is suitably connected with a source of EMF upon closure of a switch 148. This switch is arranged to be simultaneously closed with the ignition switch of the engine (not shown).

The control circuit 146 further receives an input from the engine distributor 150 indicative of engine speed and an input from a load sensing device 152 such as a throttle position sensor. It will be noted that as an alternative to throttle position, the output of an air flow meter or an induction vacuum sensor may used to indicate engine load.

A reservoir 154 is arranged beside the engine proper as shown, and arranged to communicate with the coolant jacket 120 via a conduit 156. An electromagnetically controlled valve 158 is disposed in the conduit 156 immediately downstream of a manually operable cock 160. The valve 158 is arranged to be closed when energized and open when not supplied with current. The reservoir 154 is provided with an air-permeable cap 162 so as to ensure that atmospheric pressure constantly prevails therein.

When the above arrangement is initially filled with coolant the manually operable cock 160 is closed and the coolant jacket 120 and the radiator 126 filled with pre de-aerated coolant and the cap 164 tightly closed down to hermetically seal the system. A suitable amount of additional coolant is introduced into the reservoir 154. The cock 160 is then opened. When the engine is started, the coolant heats and produces vapor pressure in the coolant jacket. It should be noted that as the coolant is stagnant within the coolant jacket, the coolant, especially that in proximity of the cylinder head and the like structure subject to high heat flux, heats quickly as, under these conditions, radiation of heat to the ambient atmosphere is severely inhibited.

The valve 158 is arranged to remain de-energized and therefore open after the start of the engine and the closure of switch 148. As the vapor pressure increases the coolant is displaced out of the coolant jacket 120 and the radiator 126 into the reservoir 154 until level of the liquid coolant is forced down to that of the level sensor 140. The level sensor 140 upon sensing the level having fallen therebelow, energizes the pump 134 to induct coolant from the radiator 126 and introduce same into the coolant jacket 120. Simultaneously, the pressure in the coolant jacket 120 continues to rise. This in combination with the operation of the pump empties the radiator 126 while maintaining the coolant jacket 120 filled to the appropriate level (viz., that of the level sensor 140) until the level of coolant in the radiator falls to that of the level sensor 145 which accordingly outputs a signal indicative thereof. This signal is used to trigger the energization of the valve 158 and close off communication between the reservoir 154 and the coolant jacket 120 whereafter the cooling system enters a "closed circuit" phase of operation wherein, as the engine continues to operate, coolant is cyclically vaporized, condensed in the radiator and pumped back into the coolant jacket under the control of the level sensor 140 and pump 134.

When the engine is stopped and the switch 148 opened, the supply of current to the valve 158 is terminated and the valve opens. Subsequently, as the engine 110 cools down and the vapor in the coolant jacket 120 and the radiator 126 condenses, the coolant which was displaced into the reservoir 154 during warm-up is reinducted filling the coolant jacket 120 and radiator 126. Under these conditions, as no subatmospheric pressure prevails in the cooling system, contaminating air is not inducted thereinto.

A further aspect of the first embodiment comes in the variation of the temperature with load on the engine.

Figure 6:
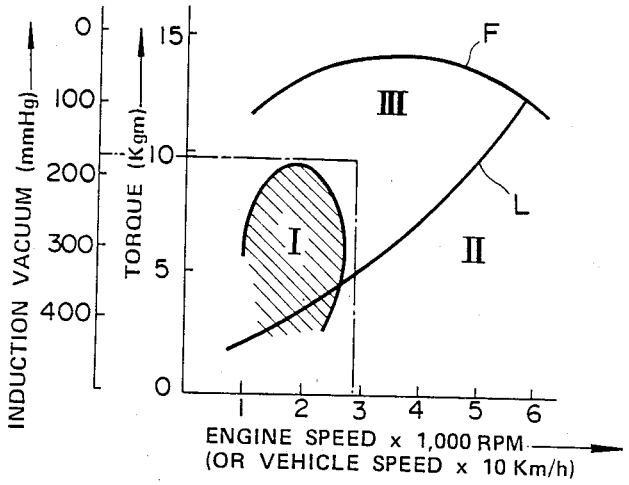
FIG. 6 is a graph showing in terms of load and vehicle or engine speed, the various load zones in which it is desirable to vary the temperature of the engine from a high level (approx 120 degrees C.) and a low value (approx. 80 degrees)

FIG. 6 graphically shows in terms of engine torque and engine speed the various load "zones" which are encountered by an automotive vehicle engine. In this graph, the curve F denotes full throttle torque characteristics, trace L denotes the resistance encountered when a vehicle is running on a level surface, and zones I, II and III denote respectively "urban cruising", "high speed cruising" and "high load operation" (such as hillclimbing, towing etc.).

A suitable coolant temperature for zone I is approximately 110–120 degrees C. while 90–80 degrees for zones II and III. The high temperature during "urban cruising" of course promotes improved fuel economy by increasing thermal efficiency while the lower temperatures obviate engine knocking and/or engine damage in the other zones. For operational modes which fall between the aformentioned first, second and third zones, it is possible to maintain the engine coolant temperature at approximately 100 degrees C.

In order to achieve the desired engine temperature control in accordance with load, the first embodiment takes advantage of the fact that, with a cooling system wherein the coolant is boiled and the vapor used a heat transfer medium, the amount of coolant actually circulated between the coolant jacket and the radiator is very small, the amount of heat removed from the engine per unit volume of coolant is very high and that, upon boiling, the pressure and consequently the boiling point of the coolant rises. Thus, by circulating only a predetermined flow of cooling air over the radiator, it is possible reduce the rate of condensation in the radiator and cause the temperature of the engine (during "urban cruising") to rise above 100 degrees for example to approximately 119 degrees C. (corresponding to a pressure of approximately 1.9 atmospheres). During high speed cruising the natural air draft produced under such conditions may be sufficient to require only infrequent energizations of the fan to induce a condensation rate which reduces the pressure in the coolant jacket to atmospheric or sub-atmospheric levels and therefore lower the engine temperature to between 100 and 80 degrees C. (for example). Of course during hillclimbing, towing and the like, the fan may be frequently energized to acheive the desired low temperature.

Figure 7:
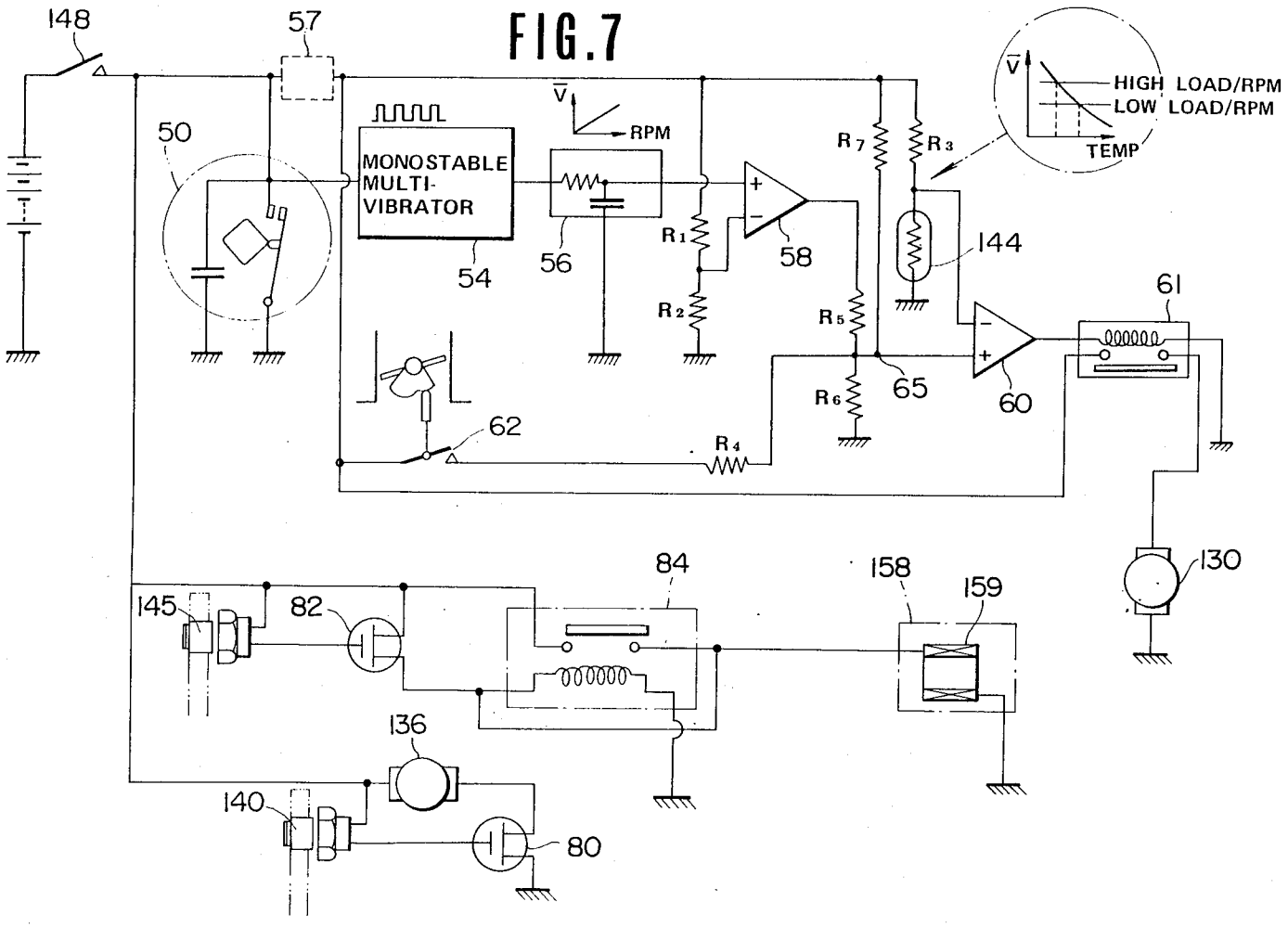
FIG. 7 shows circuitry via which the pump, valve and fan motor of the first embodiment of the present invention may be controlled.

FIG. 7 shows an example of circuitry which may by used to control the pump 134, fan 130 and valve 158 of the first embodiment.

Figure 1:
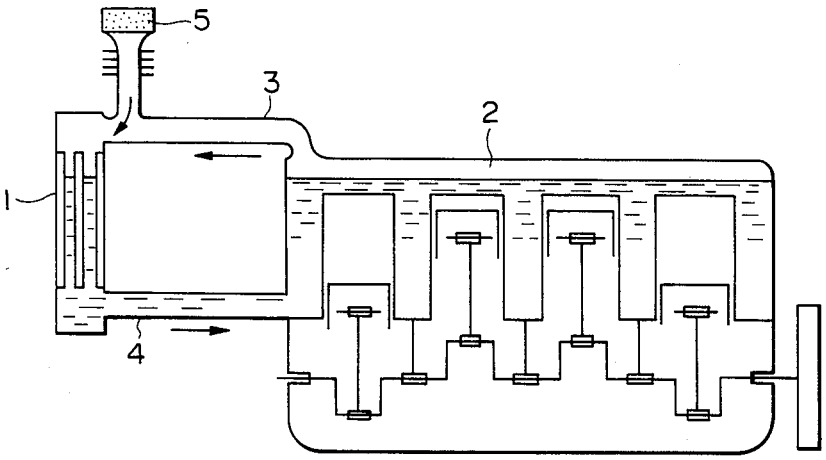
FIG.1 (PRIOR ART)
FIGS. 1, 2 and 3 schematically show the prior art arrangements discussed in the opening paragraphs of the present disclosure.
Figure 2:
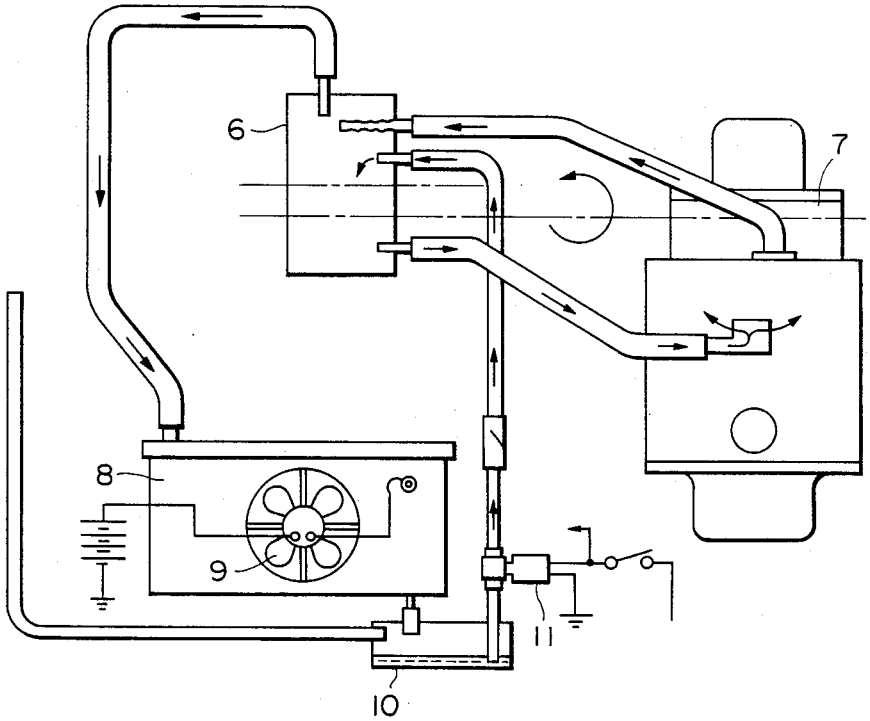
FIG.2 (PRIOR ART)
Figure 3:
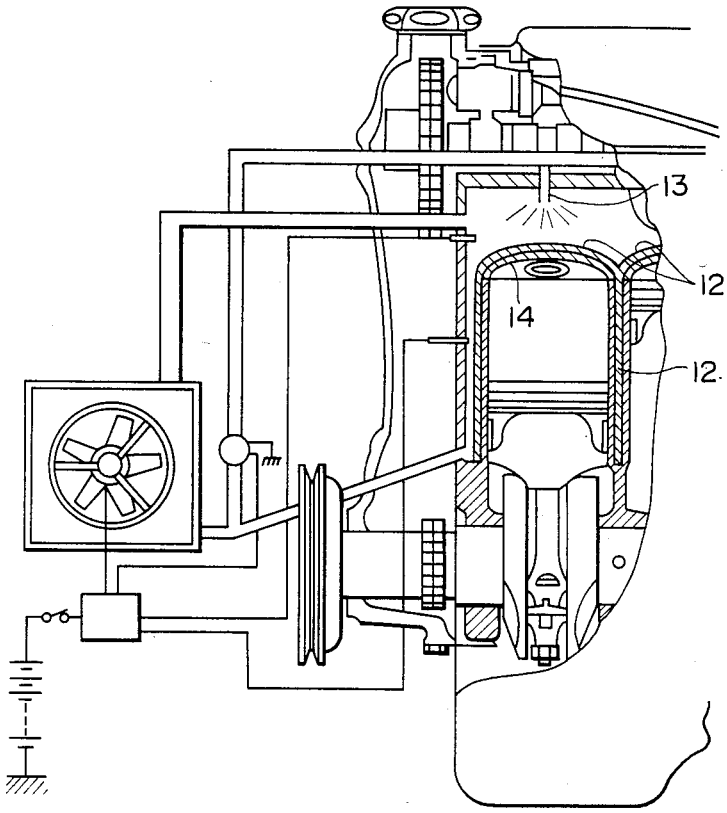
FIG. 3 (PRIOR ART)

In this circuit arrangement the distributor 50 of the engine ignition system is connected with the source of EMF (FIG. 1) via the switch 148. A monostable multivibrator 54 is connected in series between the distributor 50 and a smoothing circuit 56. A DC—DC converter 57 is arranged, as shown in broken line, to ensure a supply of constant voltage to the circuit as a whole. A voltage divider consisting of resistors R1 and R2 provides a comparator 58 with a reference voltage at one input thereof while the second input of said comparator receives the output of the smoothing circuit 56. A second voltage dividing arrangement consisting of a resistor R3 and a thermistor (viz., the temperature sensor 144) applies a variable reference voltage to a second comparator 60 which also receives a signal from a cam operated throttle switch 62 via a resistor arrangement including resistors R4, R5, R6 and R7 connected as shown. The output of the comparator 60 is applied to the fan 130 via a relay 61 for energizing same.

The circuit further includes a transistor 80 which acts a switch upon receiving an output from the level sensor 140 to establish a circuit between the source of EMF and ground. As a safety measure, an inverter or the like (not shown) may be interposed between the level sensor 40 and the transistor 80, and the level sensor adapted to produce an output when immersed in coolant. With this arrangement should the level sensor malfunction, the lack of output therefrom causes the transistor 80 to be continuously rendered conductive and the pump 36 continually energized to ensure that an adequate amount of coolant is maintained in the coolant jacket.

In order to acheive the desired control of the valve 158, the level sensor 145 is circuited via transistor 82 with a self-energizing relay 84 in a manner that, until the level of the coolant in the radiator 126 is forced to the level of the level sensor 145, the relay is not closed and the solenoid 159 of the valve 158 not energized, whereby the desired amount of coolant contained in the radiator and coolant jacket can be appropriately displaced into the reservoir 154.

Opening of the switch 148 de-energizes the solenoid and opens the self energizing relay.

As will be appreciated, with the above disclosed circuit, depending on the load and engine speed, the temperature of the coolant in the coolant jacket will be adjusted in a manner that at low engine speeds and loads the voltage appearing at the inverting terminal of the comparator 60 will be compared with the voltage appearing on the non-inverting terminal thereof and the fan 130 suitably engergized to maintain a high temperature under so called "urban cruising" conditions and lowered at high load/speed operation. Further, upon stoppage of the motor, the coolant jacket and radiator will be completely filled with coolant to exclude the possiblity of air contamination.

Figure 8:
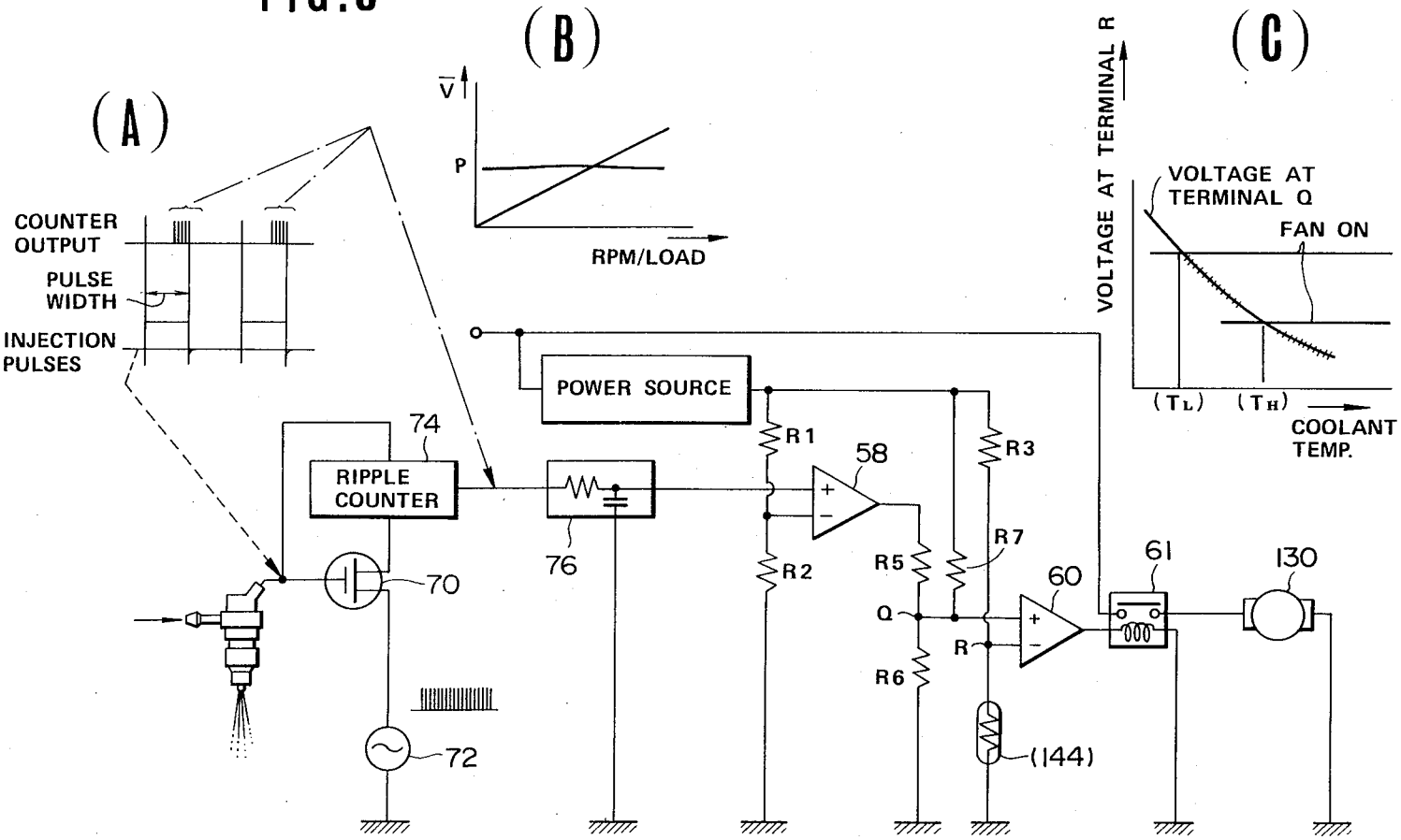
FIGS. 8A–C show a circuit arrangement similar to that in FIG. 12 but which is adapted to a fuel injected engine and which makes use of the pulses produced by the injection system to control the fan motor and the valve of the first embodiment.

FIG. 8 shows a second circuit arrangement which may be employed in the case the engine is equipped with a fuel injection system.

This alternative arrangement differs from that shown in FIG. 7 by the inclusion of a transistor 70, a clock circuit 72, a ripple counter 74 and a smoothing circuit 76, all connected as shown. Due to the fact that the frequency of injection control pulses varies with engine speed and the voltage output of the smoothing circuit 76 varies with pulse width as well as the frequency of injection, it is possible to use this arrangement in place of both of the throttle switch 62 and distributor 50 as will be appreciated by those skilled in the art. For the sake of simplicity the level sensors 140, 145 and associated circuitry have been omitted from this figure. More specifically, the operation of the FIG. 7 circuit is such that when the injector driving signal is applied to the base of the transistor 86 and the output of the clock generator 72 is fed to the ripple counter 74. The characteristics of the ripple counter 74 are so selected that it outputs a carry only when the width of the injection pulses are greater than a predetermined value (viz., indicative of a load in excess of a predetermined value). The injection driving pulses are applied to the reset terminal of the counter 74. Upon the width of the injection pulse exceeding said predetermined value, the ripple counter 74 will output a carry (a number of clock pulses) which varies with the width of the pulse in excess of the predetermined value, as will be clear from insert "A". The output of the smoothing circuit 76 accordingly increases with engine speed and load (pulse width). The output of the smoothing circuit is applied to the non-inverting terminal of the comparator 58 which receives a fixed reference voltage from the voltage divider defined by resistors R1 and R2. Accordingly, upon the voltage level of the smoothing circuit 76 output exceeding that provided by the R1–R2 voltage divider (see voltage P in insert "B"), the comparator produces an output to terminal Q.

The voltage appearing at terminal R decreases with increase of coolant temperature due to the inherent characteristics of the thermistor 144. Accordingly, if the voltage appearing on terminal R is at a high level due to the engine operating at high load/speed conditions, the fan 130 will be energized to maintain a low coolant temperature ($T_L$) as will be clear from insert "C". On the other hand, should the engine be operating under the so called "urban cruising" conditions, the voltage appearing on terminal Q will be low due to absence of an output from the comparator 58 and the fan 130 will be operated in a manner to reduce the rate of condensation in the radiator 126 and raise the temperature of the coolant to a high level ($T_H$).

Figure 9:
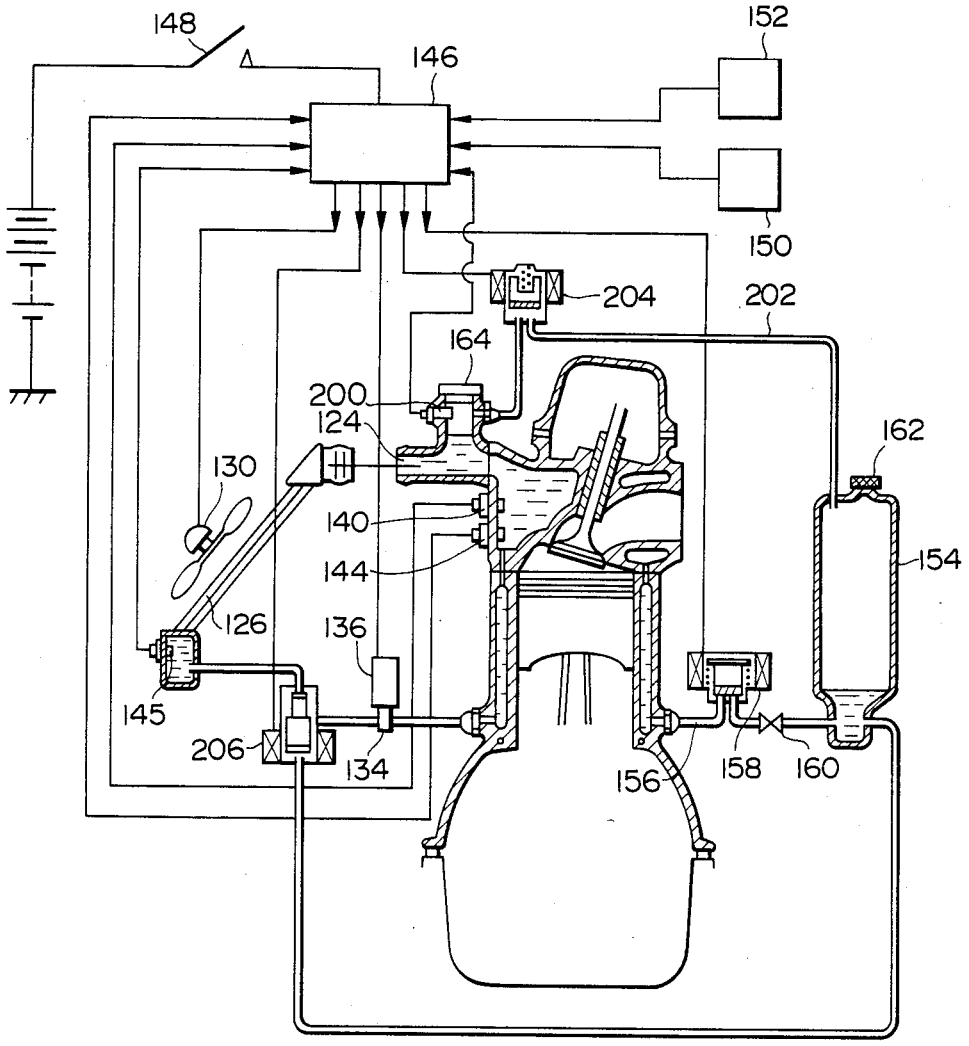
FIGS. 9 and 10 show a second embodiment of the present invention.
Figure 10:
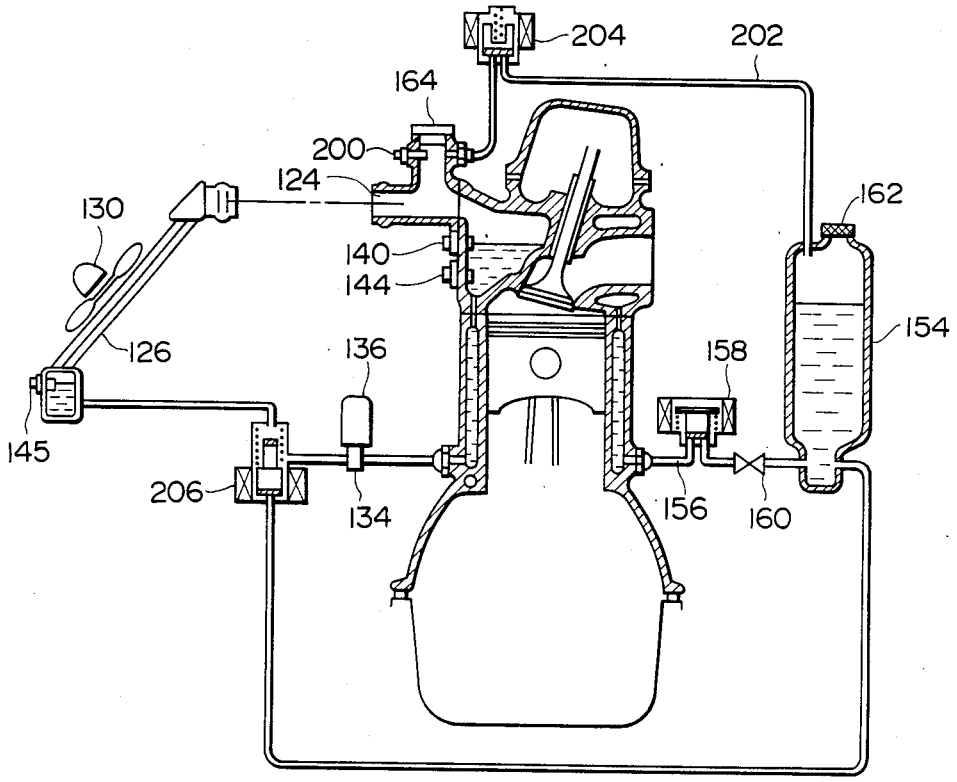

FIGS. 9 and 10 show a second embodiment of the present invention. This arrangement is basically similar to that shown in FIGS. 4 and 5 but features an arrangement which additionally permits coolant to be forced into the coolant jacket and radiator to positively displace (viz., purge out) any air or the like which may have entered the system. This feature is achieve via the provision of a third level sensor 200 just below the cap 164, an overflow conduit 202 which leads via a second solenoid controlled valve 204 to the reservoir 154 and a third solenoid controlled valve 206 which can selectively connect the induction port of the pump 134 with either the radiator 126 or the reservoir 154.

FIG. 10 shows the engine operating under "closed circuit" conditions wherein the valves 158 and 204 are closed (via energization and de-energization respectively) as shown, and the valve 206 is in a de-energized state wherein it establishes fluid communication between the radiator 126 and the induction port of the pump 134.

The control circuit 146 is arranged to, upon the engine being stopped and the temperature of the coolant falling to a predetermined level (for example 50 degrees) to de-energize the valve 158 and permit the coolant stored in the reservoir 154 to be inducted into the coolant jacket under the influence of the pressure differential which occurs under such conditions. However, should the system be contaminated with air or the like non-condensible, then the level of the coolant will not rise to that of the level sensor 200. Hence, if the level sensor senses the absence of coolant at a temperature at which the coolant jacket should be completely filled (for example ambient atmospheric temperature) then the control circuit energizes the valve 206 to establish fluid communication between the reservoir 154 and the induction port of the pump 134 and the pump motor 136 is energized. The valves 204 and 158 are also energized to assume their respective open and closed states as shown.

When, the level sensor 200 generates a signal indicative of the coolant having risen thereto, the valve 206 is de-energized to re-establish communication between the radiator 126 and the induction port of the pump 134, and valves 158 and 204 are de-energized. In order to unfailingly remove all of the air from the system, it is deemed advantageous to continue the operation of the pump and maintain the valve 206 energized for a short period (e.g. 3 to 4 seconds) after the sensor actually outputs an indication of being immersed so as to cause a small amount of coolant to overflow via conduit 202 to the reservoir 154. This positively displaces any last remaining bubbles of air from the system. This particular operation can be acheived simply by operatively interposing a suitable delay circuit between the sensor 200 and the control circuit.

It should be noted that upon a cold start, should air have contaminated the system, until the coolant reaches the previously mentioned 50 degree C. level, the same "purging" function will be carried out if the level sensor 200 detects the absence of coolant at its level. Upon the temperature reaching the predetermined level (viz., 50 degrees) the system will change from the "purging" mode to a "displacement" mode wherein the vapor pressure which is generated in the coolant jacket is used to displace the coolant out of the radiator 126 in a manner similar to that disclosed in connection with the first embodiment. It will be noted that any air dissolved in the coolant will be driven out of solution by the heating so that upon the cooling system entering the "closed circuit" mode of operation, all of the air in the system will have been purged out.

FIGS. 11 to 14 show a third embodiment of the present invention. This arrangement features the "fill-up" and "purging" modes possible with the second embodiment and further features a mode of operation whereby the radiator may be partially filled with coolant when the engine is running and the rate of cooling of the radiator due to natural drafts of air or extremely low ambient temperatures, is lower than that optimal for the particular speed/load operational conditions of the engine. That is to say when the radiator is subject to "overcooling". Under these conditions, by partially filling the radiator 126 with coolant the rate of condensation therein may reduced by reducing the surface area via which the vaporized coolant may release its latent heat of vaporization.

This arrangement differs from the second embodiment in that the valve (158) is arranged to control communication between the reservoir 156 and the return conduit 132 at a location upstream of the pump 134.

Figure 11:
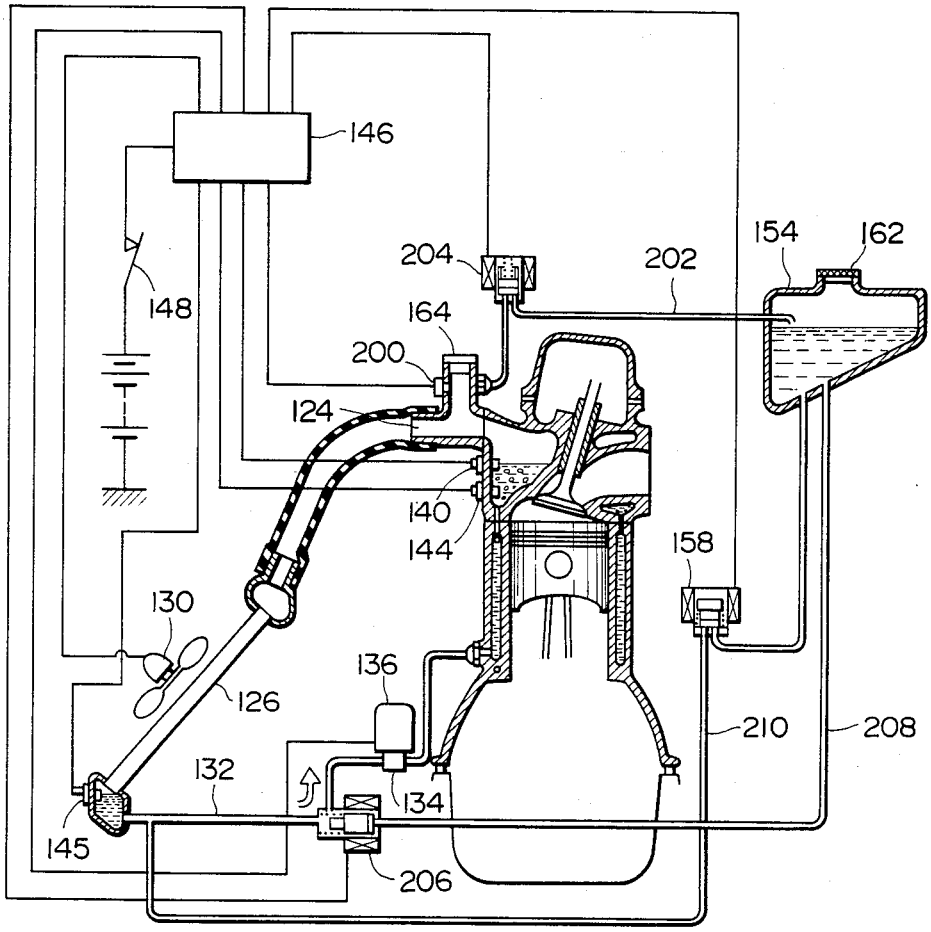
FIGS. 11–14 show a third embodiment of the present invention.

FIG. 11 shows this embodiment in its normal "closed circuit" mode of operation wherein coolant is boiled, condensed in the radiator and returned to the coolant jacket under the influence of pump 134 and level sensor 140. In this mode of operation valves 158 and 204 are closed while valve 206 selectively communicates the radiator 126 with the induction port of the pump 134 and closes off conduit 208.

Figure 12:
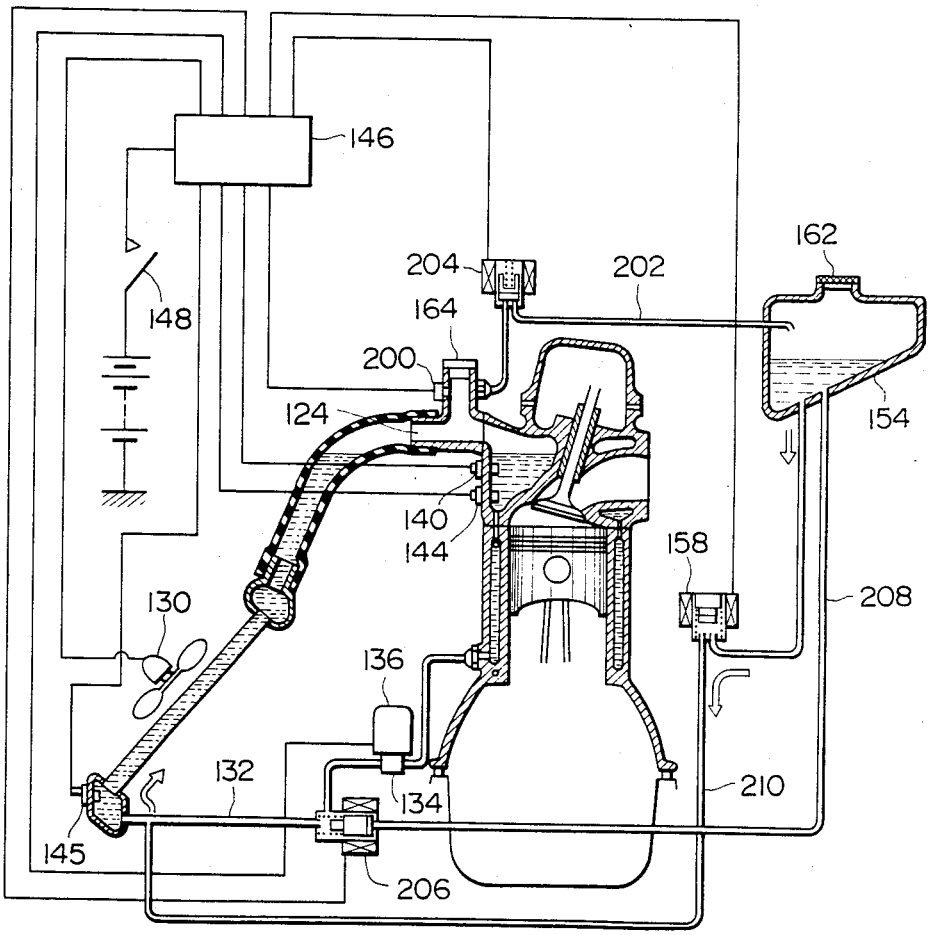
Figure 13:
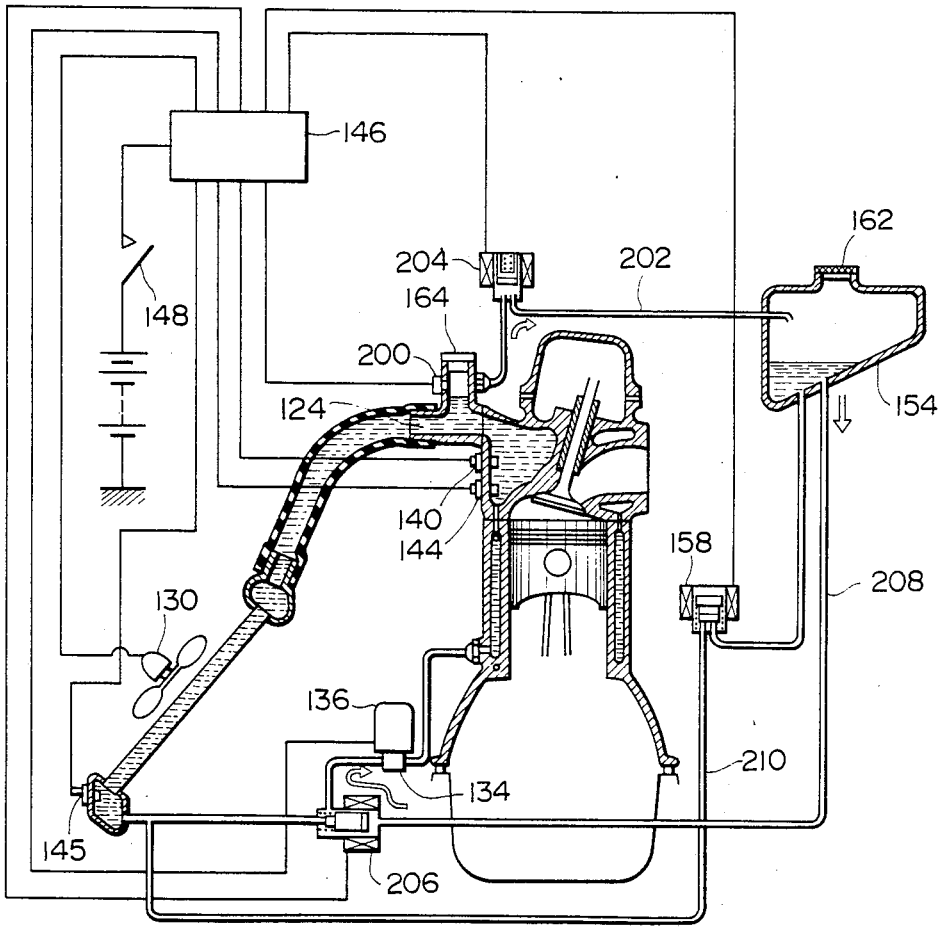

Upon the engine being stopped and the temperature thereof falling to a predetermined temperature (for example 50 degrees C.) the control circuit 146 deenergizes valve 158 whereby coolant flows under the pressure differential which exists between the interior of the coolant jacket 120 and the reservoir 154 (see FIG. 12). In this embodiment the coolant is permitted to flow into the radiator 126. If there is no air contamination the coolant level rises to completely fill the system.

However, if the temperature of the coolant is sensed at or below a second predetermined level (for example equal to that of the ambient atmosphere) and the level sensor senses the absence of coolant, the control circuit 146 energizes valves 204 and 206 to establish communication between the conduit 208 and the pump 134 and to open the overflow conduit 202. The pump motor 136 is then energized until the level of coolant is raised sufficiently to purge out the air and trigger the level sensor 200 (see FIG. 13). Upon the level sensor 200 being triggered the control circuit 146, after a brief delay of 3–4 seconds, deenergizes pump motor 136 and valves 204 and 206.

Figure 14:
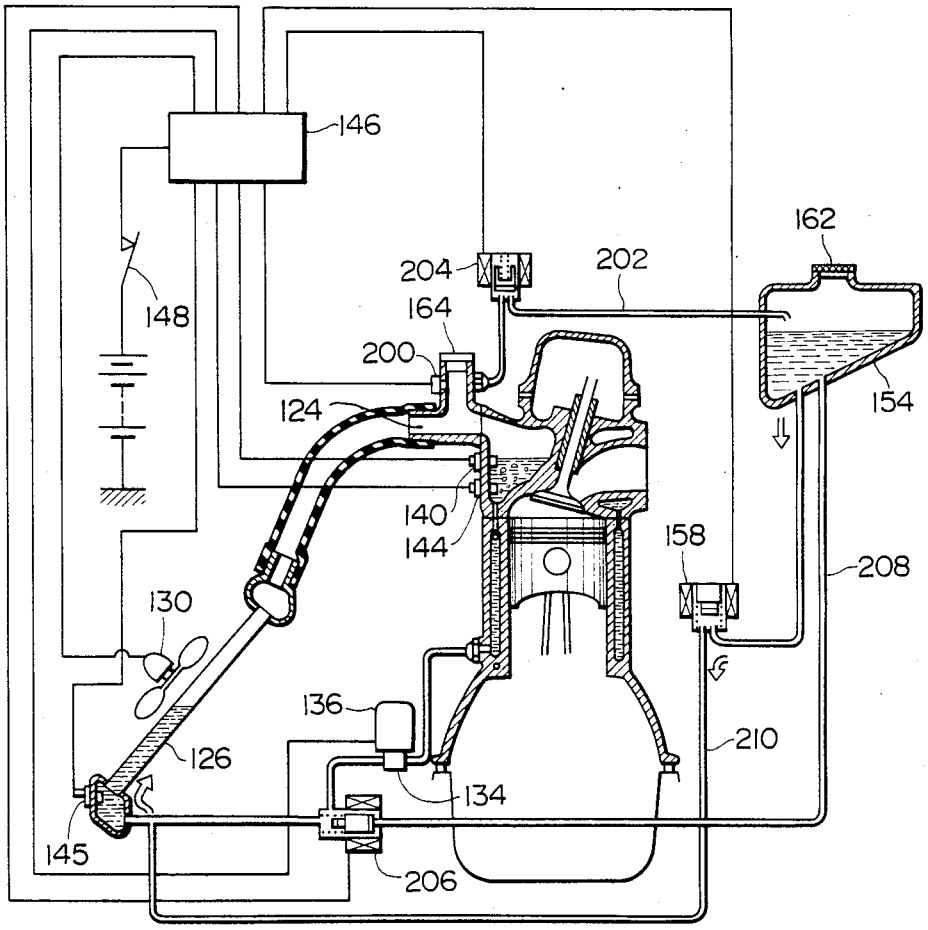

FIG. 14 shows a mode of operation which compensates for overcooling of the radiator 126 wherein the pressure within system is reduced below atmospheric and the coolant permitted to boil at a temperature lower than that optimal for the given mode of engine operation. During this phase of operation, the valve 158 is opened and coolant is allowed to flow through the conduit 210 and into the radiator 126 to partially fill same as shown in FIG. 14. This condition is maintained until the temperature of the engine coolant rises and produces sufficient pressure to displace the coolant back into the reservoir 154. The valve 158 is de-energized upon the level sensor 145 producing a signal indicative of the coolant level having reached same.

It will be noted that in the third embodiment the reservoir 154 is located of a level higher than the cylinder head 114, whereby gravity assists the filling operation after the engine stops and/or is subject to "overcooling".

Figure 15:
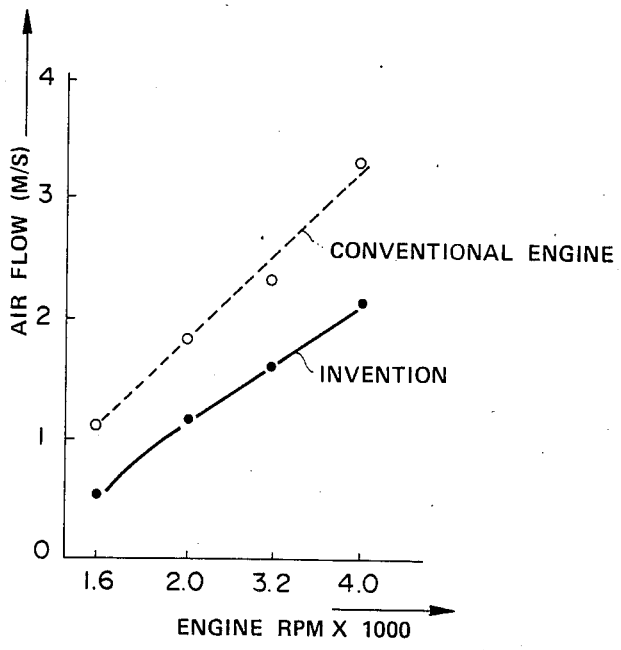
FIGS. 15–17 are graphs showing the various merits which are derived with the present invention.

FIG. 15 shows in graphical form, one of the merits of the present invention. In this graph the air flow required to maintain the engine temperature at 100 degrees C. under full throttle for a conventional water circulation type engine and that required by the present invention, are plotted against engine speed. As will be appreciated, the invention for any given engine speed provides a notably improved cooling efficiency. Accordingly, with the present invention less power is required for driving the fan.

Figure 16:
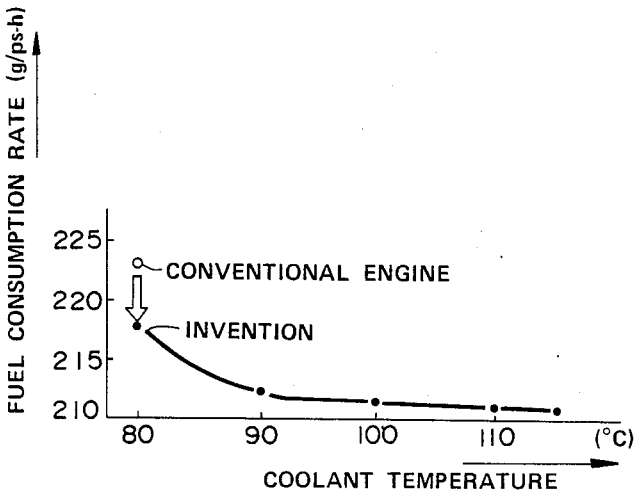

FIG. 16 shows the improvement in fuel consumption characteristics which can be expected with the present invention. One reason for the improvement comes in the elimination of the need for water circulation pump which consumes a number of horse power even at relatively low engine speeds. A further reason for the improvement comes in the ability of the invention to elevate the engine temperature under so called "urban cruising" conditions and thus increase the thermal efficiency of the engine. However, even when the temperature of the coolant is reduced to 80 degrees for high speed/load operation still the fuel economy possible with the present invention is markedly better than that with conventional cooling systems as shown.

Figure 17:
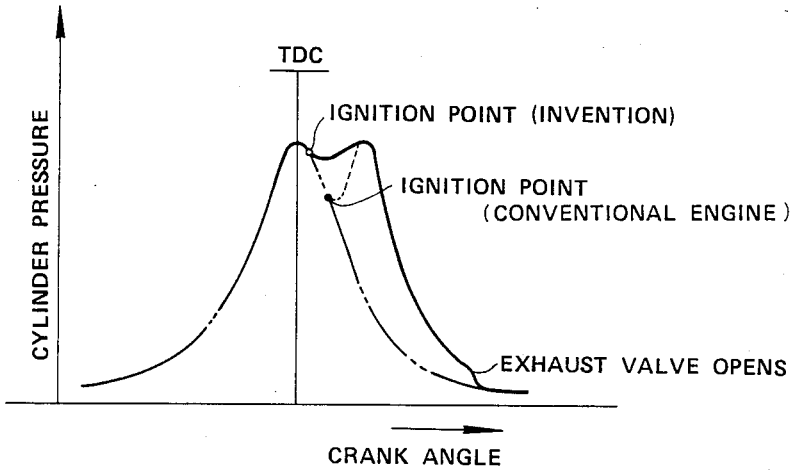

The effect of raising the engine temperature under light load conditions is particularly noticeable with Diesel engines wherein, with the increased coolant temperature, the pressure generation characteristics within the combustion chamber (see FIG. 17) are particularly improved at idling. That is to say, the delay in ignition which generates a sudden sharp pressure increase and which causes the characteristic Diesel engine noise and attendant vibration, is greatly reduced.

Another reason for increased economy comes in the ability of the invention to rapidly warm up the engine and maintain a more uniform temperature distribution throughout same.

Thus in summary, the present invention provides an engine cooling system which requires only a relatively small amount of coolant and which is therefore light in weight, which rapidly warms up, which does not become contaminated with air thus enabling prolonged trouble free use and which enables load responsive temperature control for promoting both fuel economy and safeguarding the engine against overheating.

What is claimed is:

1. In an internal combustion engine having a combustion chamber a coolant jacket into which coolant is introduced in liquid form and maintained at a level above said combustion chamber, said liquid coolant being permitted to boil;

a radiator means for condensing the gaseous coolant generated by the boiling of said liquid coolant in said coolant jacket;

a reservoir which communicates with one of said coolant jacket and said radiator, said reservoir being arranged to store coolant therein; and a control means for normally blocking communication between said reservoir and said one of said coolant jacket and said radiator means and for establishing fluid communication therebetween when one of the pressure and temperature within said coolant jacket is below a predetermined level.

2. An internal combustion engine, comprising:

a coolant jacket into which coolant is introduced in liquid form and maintained at a level above said combustion chamber, said liquid coolant being permitted to boil;

a radiator for condensing the gaseous coolant generated by the boiling of said liquid coolant in said coolant jacket;

a reservoir which communicates with one of said coolant jacket and said radiator, said reservoir being arranged to store coolant therein; and a control arrangement for normally blocking communication between said reservoir and said one of said coolant jacket and said radiator and for establishing fluid communication therebetween when one of the pressure and temperature within said coolant jacket is below a predetermined level;

a first level sensor disposed in said coolant jacket at said level higher than said combustion chamber;

a pump disposed in a return conduit leading from said radiator to said coolant jacket for returning condensed coolant from said radiator to said coolant jacket, said pump being responsive to the output of said first level sensor in a manner to maintain the level of liquid coolant at said level higher than said combustion chamber.

3. An internal combustion engine as claimed in claim 1, further comprising:

a temperature sensor for sensing the temperature of the coolant in said coolant jacket.

4. An internal combustion engine as claimed in claim 2, wherein said control arrangement comprises a first valve for controlling fluid communication between said reservoir and one of said coolant jacket and said radiator.

5. An internal combustion engine as claimed in claim 4, further comprising a second level sensor disposed at the bottom of said radiator.

6. An internal combustion engine as claimed in claim 5, wherein said control arrangement is responsive to the stoppage of said engine in a manner to open said first valve.

7. An internal combustion engine as claimed in claim 6, wherein said control arrangement is responsive to the starting of said engine and to the ouput of said second level sensor for closing said first valve.

8. An internal combustion engine as claimed in claim 5, further comprising:

a third level sensor disposed in one of said coolant jacket and said radiator and located at a level whereat it is immersed in liquid coolant only when said coolant jacket and said radiator are completely filled with liquid coolant;

a second valve which controls fluid communication between said reservoir and one of said coolant jacket and radiator, said second valve being disposed in an overflow conduit which leads from a location in close proximity of said third sensor to said reservoir; and a third valve disposed in a supply conduit which leads from said reservoir to said return conduit, said supply conduit communicating with said return conduit at a location upstream of said pump;

said control arrangement being arranged to open and close said first, second and third valves and operate said pump in response to the outputs of said third level sensor and said temperature sensor in a manner to fill said coolant jacket and radiator with liquid coolant from said reservoir until said third sensor is immersed therein and thus displace any non-condensible matter out through said overflow conduit and said second valve to said reservoir, when the temperature within said coolant jacket is at a level at which said radiator and coolant jacket should be completely filled with liquid coolant.

9. An internal combustion engine as claimed in claim 4, further comprising a manually operable valve between said first valve and said reservoir for facilitating the adjustment of the level of coolant in said coolant jacket and in said reservoir.

10. An internal combustion engine as claimed in claim 2, wherein said control arrangement comprises:

a induction conduit arrangement which permits said pump to induct coolant from said reservoir and positively pump same into said coolant jacket when non-condensible matter tends to contaminate the coolant jacket and radiator; and an overflow conduit arrangement which permits excess coolant pumped into said coolant jacket to overflow back to said reservoir and purge any contaminating non-condensible matter out of said coolant jacket and radiator.

11. An internal combustion engine as claimed in claim 2, further comprising:

a load sensor for sensing the load on said engine;

an engine speed sensor for sensing the rotational speed of said engine; and a device for controlling the amount of heat removed from said radiator, said control arrangement being arranged to be responsive to said load and engine speed sensors for controlling said device in a manner to maintain a first predetermined temperature in said coolant jacket when said engine is operating under a first set of load and engine speed conditions and a second predetermined temperature when said engine is operating under a second set of load and engine speed conditions.

12. An internal combustion engine as claimed in claim 11, wherein said device is a fan which is intermittently energized.

13. A method of operating an internal combustion engine having a combustion chamber comprising the steps of:

introducing coolant into a coolant jacket formed in said engine in a liquid form;

using said liquid coolant to absorb heat produced by said engine and converting said liquid coolant into its gaseous form;

condensing the gaseous coolant generated in said coolant jacket in a radiator;

storing a predetermined amount of coolant in a reservoir;

introducing the coolant stored in said reservoir into said coolant jacket and radiator to fill same when one of the pressure and temperature in said radiator and coolant jacket tend to fall below a first predetermined level.

14. A method as claimed in claim 13, further comprising the steps of:

sensing the level of liquid coolant in said coolant at a first level higher than said combustion chamber;

pumping condensed coolant from said radiator into said coolant jacket to maintain the level of said liquid at said first level.

15. A method as claimed in claim 14, further comprising the steps of:

inducting coolant from said reservoir and pumping same into said coolant jacket when non condensible matter tends to contaminate said radiator and coolant jacket to fill same; and permitting excess coolant pumped into said coolant jacket to overflow back to said reservoir in a manner to purge any non-condensible matter out of said coolant jacket and radiator.

16. A method as claimed in claim 14, further comprising the steps of:

sensing the level of coolant at a second level proximate the bottom of said radiator;

cutting off connection between said reservoir and said coolant jacket and radiator when the temperature of the coolant within said coolant jacket is above said first predetermined temperature and said the level of coolant in said radiator is at said second predetermined level.

17. A method as claimed in claim 13, further comprising the step of sensing the temperature of said coolant in said coolant jacket.

18. A method as claimed in claim 13, further comprising the steps of:

sensing the load on said engine;

sensing the engine speed of said engine;

controlling the amount of heat removed from said radiator in a manner to maintain a first predetermined temperature in said coolant jacket when said engine is operating under a first set of load and engine speed conditions, and a second predetermined temperature when said engine is operating under a second set of load and engine speed conditions.

19. A method as claimed in claim 13, further comprising the steps of:

sensing the level of coolant at a third level to which liquid coolant rises only when said radiator and said coolant jacket are completely filled with liquid coolant; and pumping liquid coolant from said reservoir into said coolant jacket and radiator when the temperature of said liquid coolant is at a level at which said coolant jacket and radiator should be filled with liquid coolant.

20. A method of operating an internal combustion engine having a combustion chamber comprising the steps of:

introducing coolant into a coolant jacket formed in said engine, in a liquid form;

using said liquid coolant to absorb heat produced by said engine and converting said liquid coolant into its gaseous form;

condensing the gaseous coolant generated in said coolant jacket in a radiator;

storing a predetermined amount of coolant in a reservoir; and introducing the coolant stored in said reservoir into said coolant jacket and radiator when one of the pressure and temperature in said radiator and coolant jacket is below a first predetermined level.

* * * * *